US006209238B1

(12) United States Patent
Ruvang

(10) Patent No.: US 6,209,238 B1
(45) Date of Patent: Apr. 3, 2001

(54) EXCAVATING ADAPTER-TO-LIP CONNECTION APPARATUS WITH BOTTOM FRONT-ACCESSIBLE DISCONNECTION PORTION

(75) Inventor: John A. Ruvang, Hickory Creek, TX (US)

(73) Assignee: GH Hensley Industries, Inc., Dallas, TX (US)

( * ) Notice: Subject to any disclaimer, the term of this patent is extended or adjusted under 35 U.S.C. 154(b) by 0 days.

(21) Appl. No.: 09/664,207

(22) Filed: Sep. 18, 2000

(51) Int. Cl.[7] ..... E02F 9/28
(52) U.S. Cl. ..... 37/455
(58) Field of Search ..... 37/446, 448–456, 37/457, 458; 403/374.3, 374.4, 374.2, 374.1, 379.4, 379.3

(56) References Cited

U.S. PATENT DOCUMENTS

| | | | |
|---|---|---|---|
| 1,485,879 | 3/1924 | Page . | |
| 1,736,045 | 11/1929 | Miley . | |
| 1,783,350 | 12/1930 | Watts . | |
| 1,868,247 | 7/1932 | Page . | |
| 2,167,425 | 7/1939 | Page | 37/142 |
| 2,311,463 | 2/1943 | Page | 37/142 |
| 5,713,145 | 2/1998 | Ruvang | 37/458 |

*Primary Examiner*—Christopher J. Novosad
(74) *Attorney, Agent, or Firm*—Konneker & Smith, P.C.

(57) ABSTRACT

A generally C-shaped wear member, representatively an excavating tooth adapter, is mounted on a front edge portion of an excavating bucket lip with top and bottom leg portions of the adapter respectively extending along top and bottom sides of the lip and interlocked with top and bottom ends of a base structure removably received in an opening in the lip. The top and bottom legs of the adapter are respectively and removably secured to the top and bottom ends of the base structure with top and bottom fastening structures. The bottom fastening structure has a disconnection portion which is conveniently accessible from a front bottom location on the adapter, and is useable to disconnect the bottom leg of the adapter from the base without having to reach under the lip to the rear end of the bottom adapter leg to effect such disconnection.

47 Claims, 7 Drawing Sheets

EXCAVATING ADAPTER-TO-LIP CONNECTION APPARATUS WITH BOTTOM FRONT-ACCESSIBLE DISCONNECTION PORTION

BACKGROUND OF THE INVENTION

The present invention generally relates to excavating apparatus and, in a preferred embodiment thereof, more particularly provides improved apparatus for removably attaching a wear member, such as an excavating tooth adapter, to the lip portion of an excavating device such as a bucket, dipper or the like.

Large excavating buckets, dippers or the like are typically provided with a series of earth-cutting teeth which are each formed from two primary parts—a relatively large adapter and a relatively small replaceable point. The adapter has a base portion which is connectable to the forward lower lip of the bucket, and a nose portion onto which the tooth point is removably secured by a suitable connecting pin or other connecting structure. Compared to that of the adapter, the useful life of the point is rather short—the adapter typically lasting through five or more point replacements until the tremendous earth forces and abrasion to which the adapter is subjected necessitates its replacement.

Various structures have been previously proposed for removably securing adapters, and other wear members such as wear shrouds, to excavating lip structures. For example, in U.S. Pat. No. 5,713,145 to Ruvang a wear shroud having a generally C-shaped cross section is removably secured to the front edge of an excavating bucket lip by first placing the front lip edge in the interior of the wear shroud so that the top and bottom legs of the shroud respectively extend along the top and bottom sides of the lip. A rear end portion of the top shroud leg is then removably secured, using a J-bolt, to a base structure welded to the top side of the lip. A nut threaded onto the J-bolt at the rear end of the top shroud leg and facing the welded base structure prevents the forward removal of the installed wear shroud from the bucket lip. To permit such removal, it is necessary to gain access to the rear end of the top shroud leg and rearwardly remove the nut from the J-bolt.

This technique securely attaches the wear shroud to a front edge portion of the lip with only the top leg of the shroud being anchored, via the top side lip weld base, to the lip. When a larger wear member, such as an excavating tooth adapter, is to be removably attached to the lip it is typically desirable to additionally anchor a rear end portion of the bottom wear member leg to the lip to increase the strength of wear member attachment. using this J-bolt attachment technique on both of the top and bottom wear member legs would, of course substantially increase the strength with which the wear member was removably held on the bucket lip. However, to decouple the bottom wear member leg from the lip it would be necessary to gain access to the rear end of the bottom wear member leg which is positioned a substantial distance from the front lip edge along the underside of the lip. This requirement to access the rear end of the bottom wear member leg beneath the typically massive bucket lip would undesirably make its decoupling from the bucket lip an awkward, difficult and potentially dangerous task.

It can thus be seen that a need exists for apparatus for removably securing the rear ends of both of the upper and lower leg portions of a wear member, such as an excavating tooth adapter, to a bucket lip in a manner permitting the decoupling of the lower leg from the lip without having to access the rear end of the lower leg. It is to this need that the present invention is directed.

SUMMARY OF THE INVENTION

In carrying out principles of the present invention, in accordance with a preferred embodiment thereof, excavating apparatus is provided which includes a lip structure, disposed for example on an excavating bucket, a wear member, representatively an excavating tooth adapter, and specially designed fastening apparatus useable to removably mount the wear member on the lip structure.

The wear member has a generally C-shaped cross section with a front end portion from which top and bottom legs extend along a cavity. In the assembled apparatus a front edge portion of the lip structure is removably received within the cavity, with the top and bottom legs of the wear member respectively extending along the top and bottom sides of the lip structure. A first fastening structure, illustratively including a spring-loaded J-bolt assembly, removably connects a rear end portion of the top wear member leg to the top side of the lip structure rearwardly of its front edge. A second fastening structure removably connects a rear end portion of the bottom wear member leg to the bottom side of the lip structure rearwardly of its front edge.

According to a key aspect of the invention, the second fastening structure has a disconnection portion accessible and loosenable from a front bottom portion of the wear member, disposed forwardly of the rear end portion of the bottom leg, to permit the bottom wear member leg to be disconnected from the bottom side of the lip structure without having to reach under the lip structure to the rear end portion of the bottom wear member leg. This capability of disconnecting the bottom wear member leg from a front portion thereof, as opposed to having to reach clear back to its rear end under the lip structure, makes the overall wear member removal task safer and more convenient.

Preferably, the disconnection portion of the second fastening structure is forwardly movable during loosening thereof, and is illustratively a threaded member—in one representative embodiment of the invention being a nut, and in another representative embodiment of the invention being a bolt. Additionally, at least one of the first and second fastening structures is operative to resiliently bias the front end portion of the installed wear member rearwardly toward the front edge of the excavating lip structure to thereby effect a self-tightening connection of the wear member to the lip.

In accordance with other features of the invention, the excavating apparatus further comprises a base member removable securable to the excavating lip structure with an upper end portion extending above the top side of the excavating lip structure and defining a portion of the first fastening structure, and a lower end portion extending below the bottom side of the excavating lip structure and defining a portion of the second fastening structure. Representatively, the excavating lip structure has an opening disposed therein rearwardly of its front edge and extending between its top and bottom sides, and the base member is removably insertable into this lip structure opening, with the bottom leg of the wear member being releasably interlockable with the lower end portion of the base member. Preferably, the second fastening structure further includes a base clamp member releasably interlockable with the lower end portion of the base member and with the bottom wear member leg in the assembled excavating apparatus, and a securement structure for releasably securing the bottom wear member leg to the base clamp member. The securement structure preferably includes a threaded member extendable from the base clamp member forwardly through a portion of the bottom wear member leg.

In one embodiment of the excavating apparatus, the threaded member is fixedly secured to the base clamp member and has a front end portion, the removal portion is a nut threadable onto the front end portion of the threaded member, and a spring is compressed between the nut and a facing portion of the bottom wear member leg and functions to resiliently bias the front end portion of the wear member toward the front edge of the lip structure.

In another embodiment of the excavating apparatus, the threaded member is a bolt defining the removal portion and having a rear end threadable into the base clamp member, and a front end with a head thereon. A spring member is positioned to be compressed between the head and a facing portion of the bottom wear member leg and resiliently bias the front end portion of the wear member toward the front edge of the lip structure.

In one version thereof, the base clamp member representatively has a generally U-shaped configuration with opposite leg portions releasably interlockable with opposite side portions of the lower end portion of the base member and with the bottom wear member leg. In another version thereof, the base clamp member has an opening therein through which a lower end portion of the base member may be downwardly inserted, and the base clamp member opening and the lower end portion of the base member have cooperating lug and recess portions useable to releasably interlock the base clamp member and the lower end portion of the base member. Outer side edge portions of this base clamp member embodiment are also preferably releasably interlockable with the bottom wear member leg.

To facilitate the removable connection of the generally C-shaped wear member to the excavating lip structure, and in accordance with another feature of the present invention, the inner side surface of the bottom wear member leg has a recess formed therein and the bottom leg further has at least one cutout area formed in an external side surface portion thereof disposed forwardly of the recess and separated therefrom by a dividing wall with an opening formed therein through which a threaded disconnection member may be extended between the cutout area and the recess. In one version of the wear member a pair of cutout areas are formed on exterior side surface portions of the bottom leg, and in another version a single cutout area is disposed on a bottom exterior side surface of the bottom wear member leg.

The base member preferably has a portion removably and interlockingly insertable into the recess, and the base clamp structure is preferably removably insertable into the recess into interlocking engagement with the base member and the bottom wear member leg. A threaded structure is extendable through the dividing wall opening and is useable to removably hold the base clamp member in interlocked engagement with the bottom wear member leg and the base member. Additionally, a resilient structure is provided and is connectable to the threaded structure within the cutout area to resiliently bias the base clamp structure toward the dividing wall.

DETAILED DESCRIPTION

Figures 1, 2:
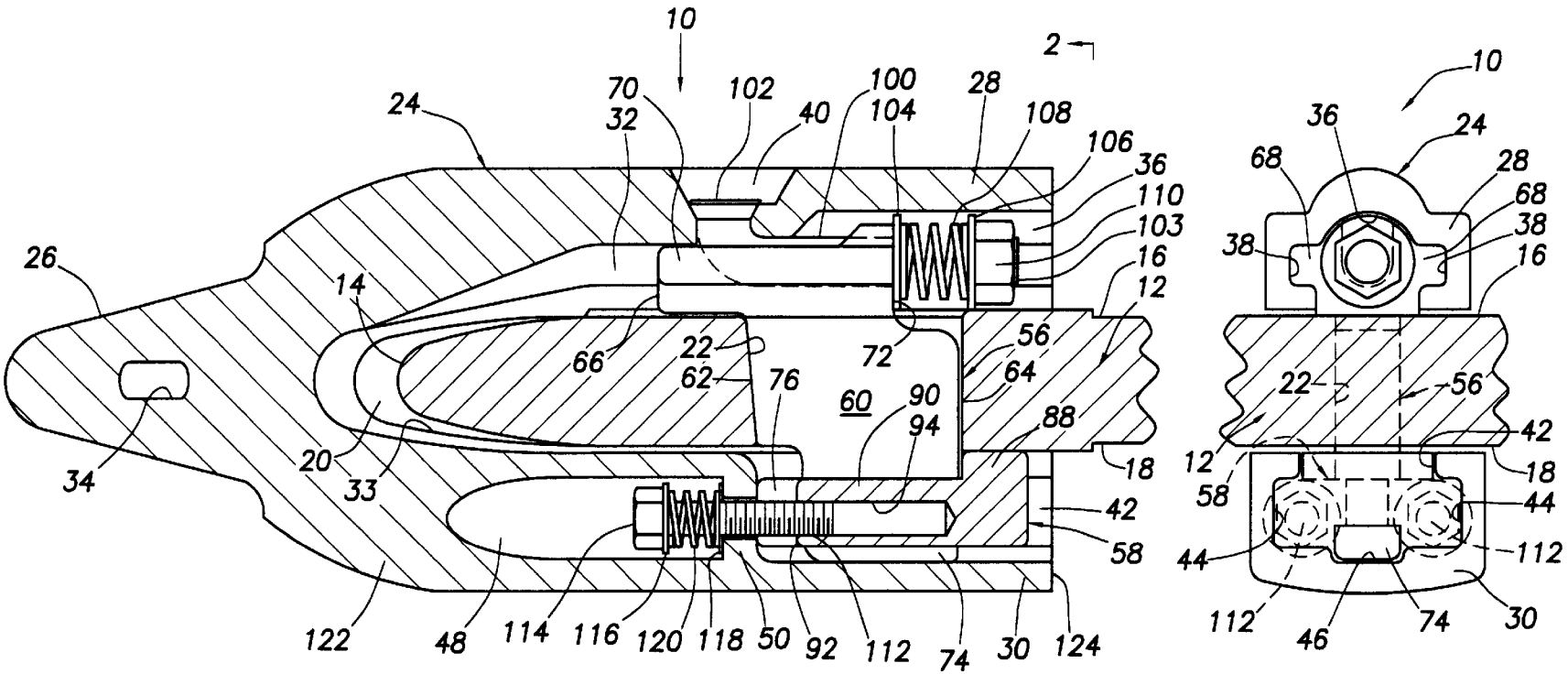
FIG. 1 is a cross-sectional view through a portion of an excavating adapter/lip assembly portion of a representative excavating bucket having incorporated therein a specially designed adapter-to-lip connection structure embodying principles of the present invention.
FIG. 2 is a cross-sectional view through the assembly taken along line 2—2 of FIG. 1.

Cross-sectionally illustrated in FIGS. 1 and 2 is a portion of an excavating device 10, representatively an excavating bucket, which includes a bottom lip structure 12 having a front edge 14 from which top and bottom sides 16,18 rearwardly extend. A series of forwardly extending locator projections 20 (only one of which is visible in FIG. 1) are spaced apart along the length of the front lip edge 14, and a spaced series of mounting openings 22 (only one of which is shown in FIGS. 1 and 2) are formed through the lip structure 12. Each opening 22 is spaced rearwardly apart from the front lip edge 14, extends between the top and bottom sides 16,18 of the lip structure 12, and is aligned with one of the locator projections 20.

Figure 3:
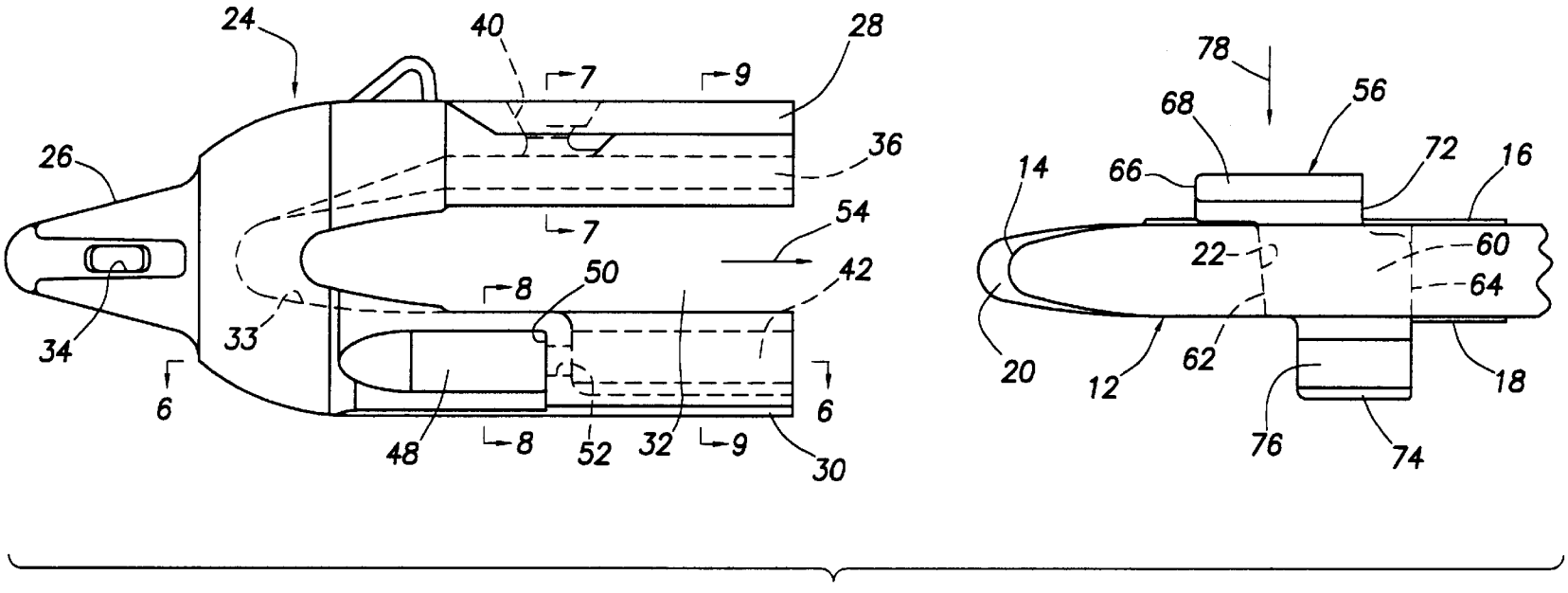
FIG. 3 is a partially exploded side elevational view of a portion of the assembly.
Figure 4:
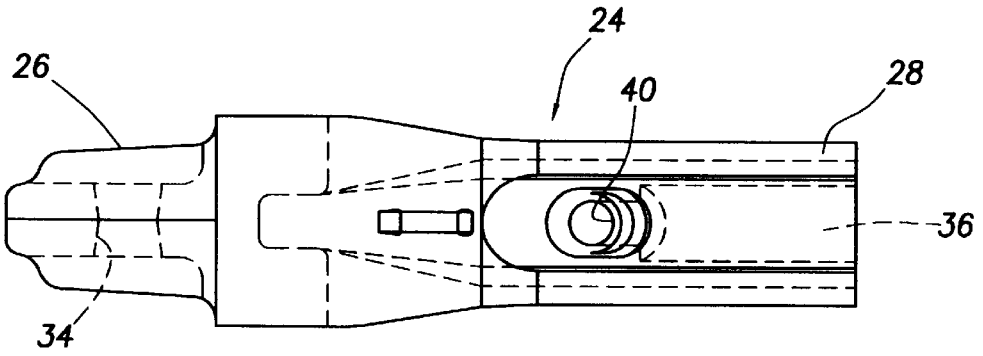
FIG. 4 is a top plan view of the adapter portion of the assembly.
Figure 5:
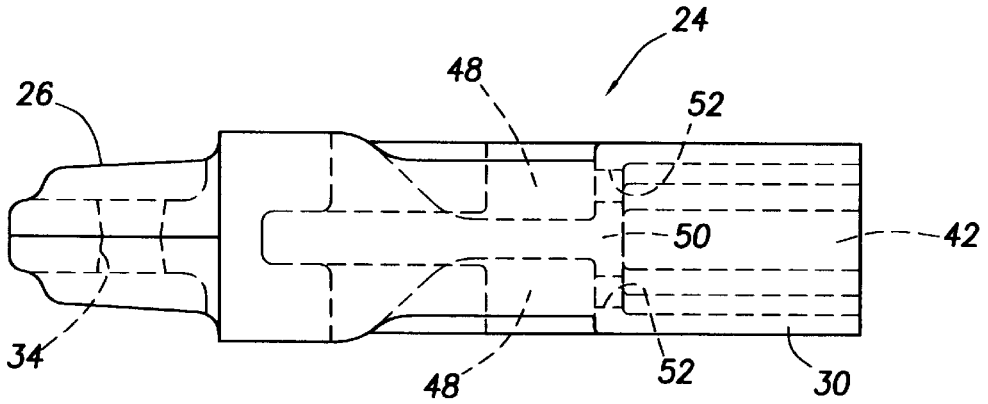
FIG. 5 is a bottom plan view of the adapter.
Figure 6:
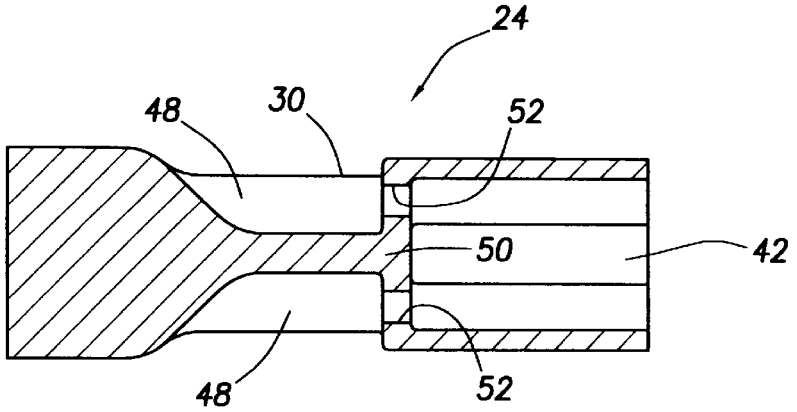
FIG. 6 is a cross-sectional view through a bottom leg portion of the adapter taken along line 6—6 in FIG. 3.

With reference now to FIGS. 1–9, at each locator projection 20 is a wear member 24 which is representatively an excavating tooth adapter, but could be another type of wear member such as a lip protector or other wear shroud structure. In cross-section, as shown in FIGS. 1–3, the illustrated adapter 24 has a generally C-shaped configuration, having a front end or "nose" portion 26 from which elongated top and bottom legs 28,30 longitudinally extend rearwardly along top and bottom sides of a rearwardly opening cavity 32 between the top and bottom legs 28,30. Cavity 32 has a front end portion 33 which is shown in FIGS. 1 and 3. Adapter nose 26 has a connection opening 34 extending therethrough and is configured to be removably received in the complementarily configured socket of a replaceable tooth point (not shown). In a conventional manner, a connector structure may be extended through the adapter nose opening 34, and corresponding openings in the tooth point, to removably hold the tooth point on the adapter nose 26.

The top adapter leg 28 has a downwardly opening bottom side cavity 36 (see FIGS. 7 and 9) extending along its length and defining opposing side Slots 38 along the interior surface of the leg 28. A connection opening 40 extends downwardly through a longitudinally intermediate portion of the top leg 28 and communicates with its bottom side cavity 36 for purposes later described herein. The bottom adapter leg 30 has an upwardly opening top side cavity 42 (see FIG. 9) extending along a rear end portion of the leg 30 and defining opposing side slots 44, and a bottom side depression 46, along the interior surface of the leg 30. For purposes subsequently set forth herein, cutout areas 48 (see FIGS. 1, 3 and 8) are formed externally on horizontally opposite sides of the bottom leg 30 forwardly of its rear end cavity 42. Cutout areas 48 are separated from the bottom leg cavities 42 by dividing walls 50 having circular openings 52 extending therethrough between the cutout areas 48 and the cavities 42.

The adapter 24 cross-sectionally depicted in FIG. 1 as being removably mounted on a front edge portion of the lip structure 12 is one of a spaced apart series of adapters similarly positioned on the lip structure and is positioned on the lip structure 12 by rearwardly moving the adapter 24 toward the front edge 14 of the lip structure 12, as indicated by the arrow 54 in FIG. 3, until the indicated front edge portion of the lip structure 12 is received in the adapter cavity 32, with the lip locator projection 20 complementarily received within the front adapter cavity portion 33. TO releasably retain the mounted adapter 24 on the front edge portion of the lip structure 12, the present invention provides specially designed connection apparatus that includes first and second fastening structures which, as later described herein, are used to respectively and removably attach rear end portions of the top and bottom adapter legs 28,30 to the top and bottom sides 16,18 of the lip structure 12. The connection apparatus comprises the lip opening 22, a base member 56, and a base clamp member 58.

Figure 12:
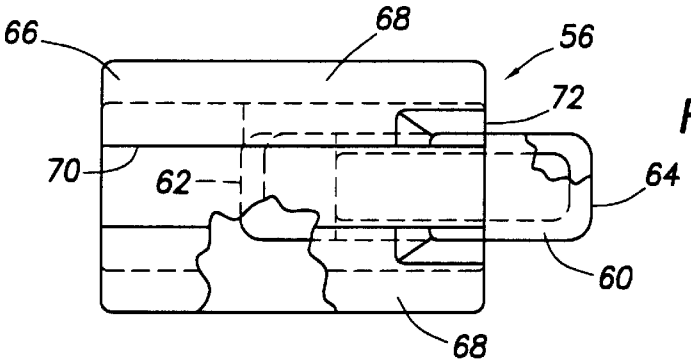
FIG. 12 is a partially cut away top plan view of the base.
Figure 11:
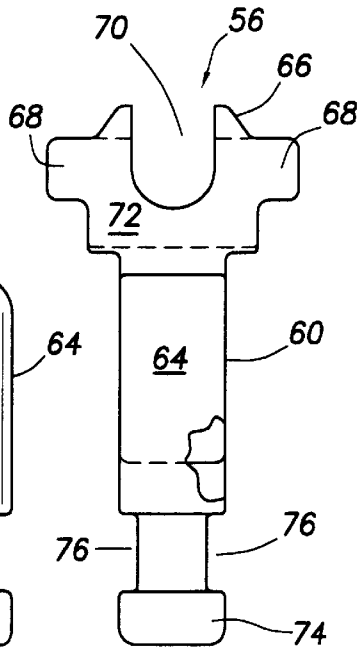
FIG. 11 is a partially cut away rear elevational view of the base.
Figure 10:
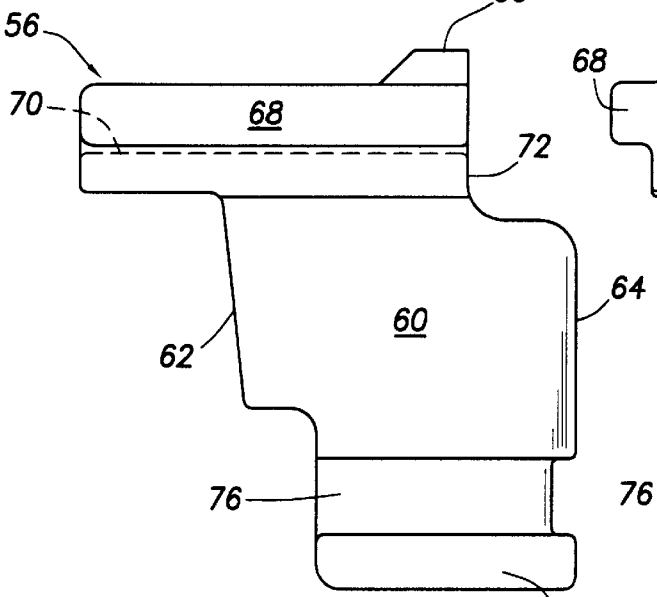
FIG. 10 is a side elevational view of a base portion of the assembly.
Figure 8:
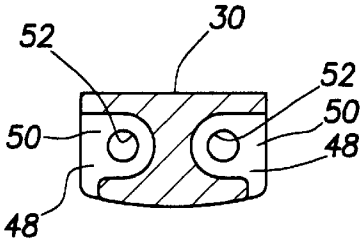
FIG. 8 is a cross-sectional view through the bottom leg of the adapter taken along line 8—8 of FIG. 3.
Figure 7:
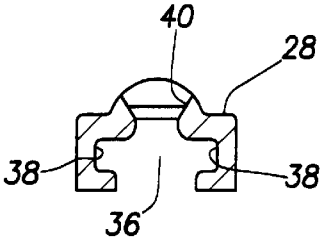
FIG. 7 is a cross-sectional view through a top leg portion of the adapter taken along line 7—7 of FIG. 3.
Figure 9:
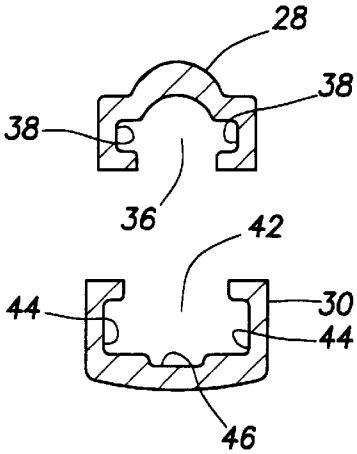
FIG. 9 is a cross-sectional view through the top and bottom legs of the adapter taken along line 9—9 of FIG. 3.

With reference now to FIGS. 10–12, the base member 56 has a vertically intermediate portion 60 with front and rear side edges 62 and 64; a forwardly offset top end portion 66 with oppositely projecting side flanges 68, a top side depression 70, and a rear side face 72; and a bottom end portion 74 with opposite side depressions 76 thereon. As illustrated by the arrow 78 in FIG. 3, the base member 56 may be downwardly and removably inserted into the lip structure opening 22 until the forwardly offset top end portion 66 of the base member 56 contacts the top side 16 of the lip structure 12 and blocks the inserted base member 56 from simply falling through the lip structure opening 22. With the base member 56 inserted into the lip structure opening 22 in this manner, a top end portion of the base member 56, including its top end flanges 68, projects upwardly beyond the top side 16 of the lip structure 16, and a bottom end portion of the base member 56, including its opposite side recesses 76, projects downwardly beyond the bottom side 18 of the lip structure 12.

Figure 15:
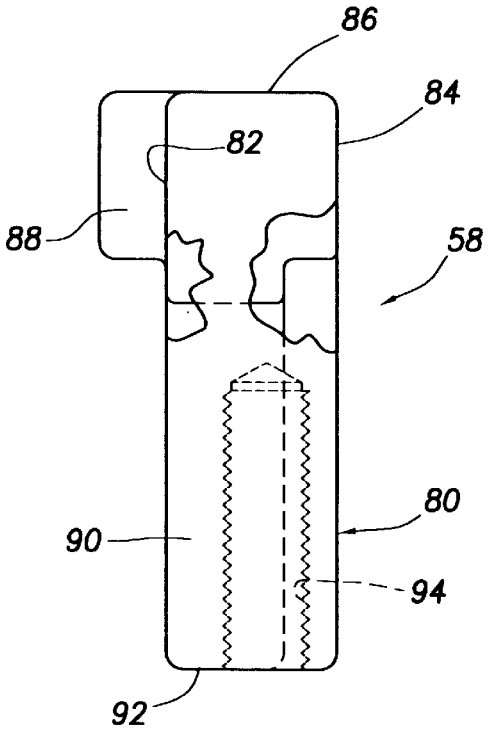
FIG. 15 is a partially cut away side elevational view of the base clamp.
Figure 14:
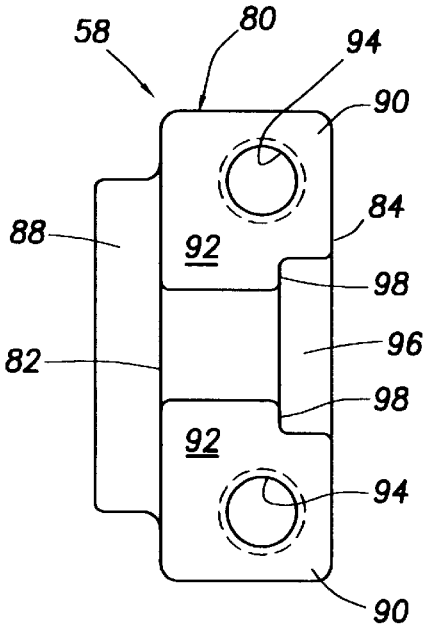
FIG. 14 is a front end view of the base clamp.
Figure 13:
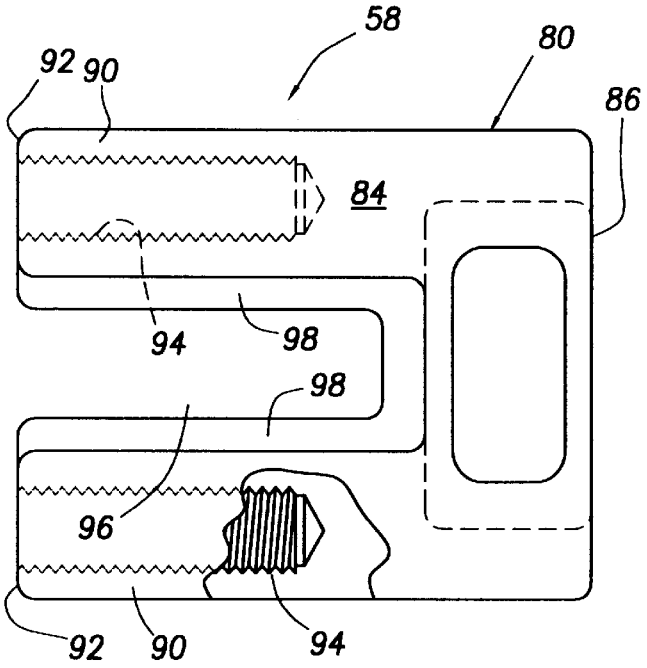
FIG. 13 is a partially cut away bottom plan view of a base clamp portion of the assembly.

Turning now to FIGS. 13–15, the base clamp member 58 has a generally U-shaped body 80 with opposite top and bottom sides 82 and 84; a rear end surface 86; an upwardly projecting rear end boss 88; and spaced apart opposite parallel legs 90 having front end surfaces 92 through which threaded openings 94 rearwardly extend. A rectangular recess 96 formed in the bottom side 84 provides the legs 90 with upwardly reduced thickness facing inner side portions 98.

With the base member 56 downwardly inserted into the lip structure opening 22 (see FIG. 3), the adapter 24 is moved rearwardly onto the front edge portion of the lip structure 12 as cross-sectionally depicted in FIG. 1. This causes the top flanges 68 of the upper end portion 66 of the base member 56 to slidably and complementarily enter the opposing side slots 38 in the top adapter leg 28 (see FIG. 2), and also causes the bottom end 74 of the base member 56 to be complementarily received in the bottom side depression 46 in the bottom adapter leg 30 (see FIG. 2). This interlocking between top and bottom end portions of the base member 56 and the top and bottom adapter legs 28,30 vertically restrains rear end portions of the adapter legs 28,30 relative to the top and bottom sides 16,18 of the lip structure 12, with such top and bottom end portions of the base member 56 respectively defining portions of the aforementioned first and second fastening structures.

The balance of the first fastening structure (see FIG. 1) includes a J-bolt 100 having an enlarged transverse head portion 102 and an opposite end portion 103; a pair of annular washers 104 and 106; a coiled compression spring 108, and a nut 110. J-bolt 100 is installed by inserting its end 103 downwardly through the top adapter leg upper side opening 40, and then forwardly tipping the J-bolt 100 and passing its end portion 103 rearwardly through the top side recess 70 of the base member 56 until the enlarged bolt head portion 102 is seated as shown within the adapter leg opening 40. The washers 104,106 and the spring 108 are then installed as shown in the bolt end portion 103, and the nut 110 is threaded onto the bolt end portion 103, against the washer 106, and tightened to compress the spring 108. In a manner similar to that shown in U.S. Pat. No. 5,713,145 to Ruvang, the compressed spring 106 transmits to the top adapter leg 28, via the J-bolt 100, a rearwardly directed force which resiliently biases a front end portion of the installed adapter 24 toward the front lip edge 14 to automatically tighten the adapter 24 rearwardly against a front edge portion of the lip 12 as the adapter/lip interface area begins to be worn away during use of the excavating bucket 10.

As previously mentioned, the second fastening structure, which is used to removably connect a rear end portion of the bottom adapter leg 30 to the bottom side 18 of the lip structure 12, includes the downwardly projecting bottom end portion74 of the base member 56. The second fastening structure (see FIG. 1) also includes the base clamp member 58, a pair of straight bolts 112 having heads 114 thereon; a pair of annular washers 116 and 118; and a coiled compression spring 120.

With reference now to FIGS. 1 and 2, the base clamp member 58 is received within the top side cavity 42 of the bottom adapter leg 30, is rearwardly removable from the cavity 42, and is releasably interlocked with both the bottom adapter leg 30 and a bottom portion of the base member 56. Specifically, the inner side portions 98 of the base clamp member legs 90 (see FIGS. 13 and 14) are slidably and complementarily received in the opposite sides depressions 76 of the bottom end portion 74 of the base member 56 (see FIGS. 10 and 11), and outer side edge portions of the base clamp member legs 90 are slidably and complementarily received in the opposing side slots 44 (see FIGS. 2 and 9) in the lower adapter leg 30. As best illustrated in FIG. 1, the front ends 92 of the base clamp member legs 90 are spaced rearwardly apart from the dividing walls 50 of the bottom adapter leg 30, and the base clamp member rear end boss 88 abuts the rear edge 64 of the base member 56.

The bolts 112 extend rearwardly through the lower adapter leg side cutout areas 48, nonthreadingly and axially movably extend through the dividing wall openings 52 into the bottom leg cavity 42 (see FIGS. 1 and 6), and are threaded into the base clamp member leg openings 94 (see FIGS. 1 and 13). The bolt heads 114 are disposed within the cutout areas 48, and the washers and spring 116,118,120 are interposed between each bolt head 114 and its associated dividing wall 50 as illustrated in FIG. 1. The bolts 112 are tightened into the base member leg openings 94 in a manner compressing the springs 120. This, in turn, causes the compressed springs 120 to exert on the dividing walls 50 rearwardly directed forces which assists the top spring 108 in rearwardly biasing the installed adapter 24 to maintain a resilient self-tightening force thereon relative to the lip structure 12.

According to a key aspect of the invention, the lower bolts 112 form disconnection portions of the second or lower fastening structure which are accessible, loosenable and removable from a front bottom portion 122 of the adapter 24, disposed forwardly of the rear end portion 124 of the bottom adapter leg 30, to permit the bottom leg 30 to be disconnected from the bottom side 18 of the excavating lip structure 12 without having to reach under the lip structure 12 to the rear end 124 of the adapter 24. As can be seen in FIG. 1, the bolt heads 114 disposed in the side cutout areas 48 of the bottom adapter leg 30 may be easily reached, for disconnection and removal, from the front of the adapter 24 without having to access the rear end 124 of the bottom adapter leg 30. This advantageously renders the disconnection of the bottom adapter leg 30 from the lip structure 12 easier and safer.

Figure 16:
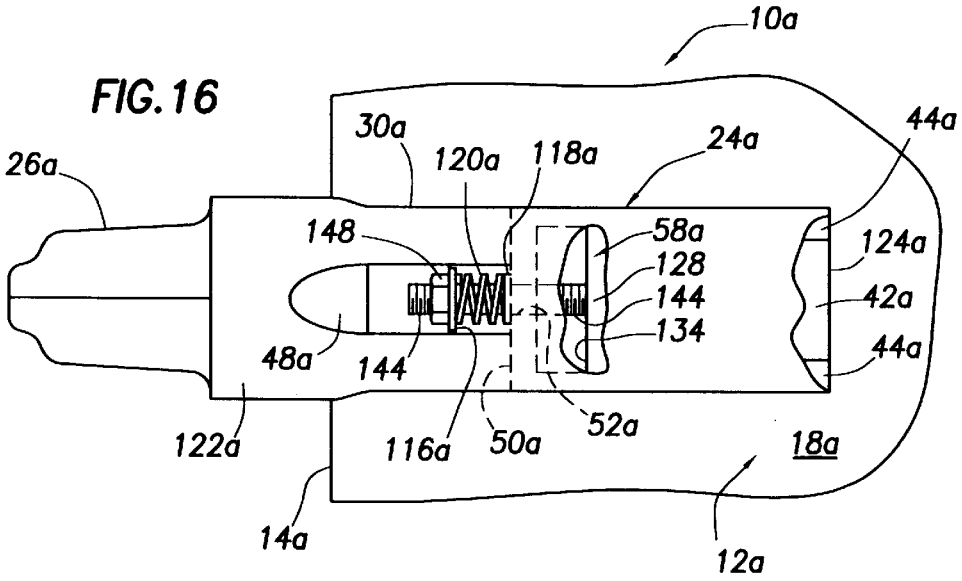
FIG. 16 is a partially cut away bottom plan view of an alternate embodiment of the excavating adapter/lip assembly.

An underside portion of an alternate embodiment 10*a* of the previously described excavating bucket 10 is illustrated in FIG. 16. For ease in comparing the excavating bucket embodiments 10 and 10*a*, components in the embodiment 10*a* similar to those in embodiment 10 have been given the same reference numerals having the suffixes "a".

Figure 17:
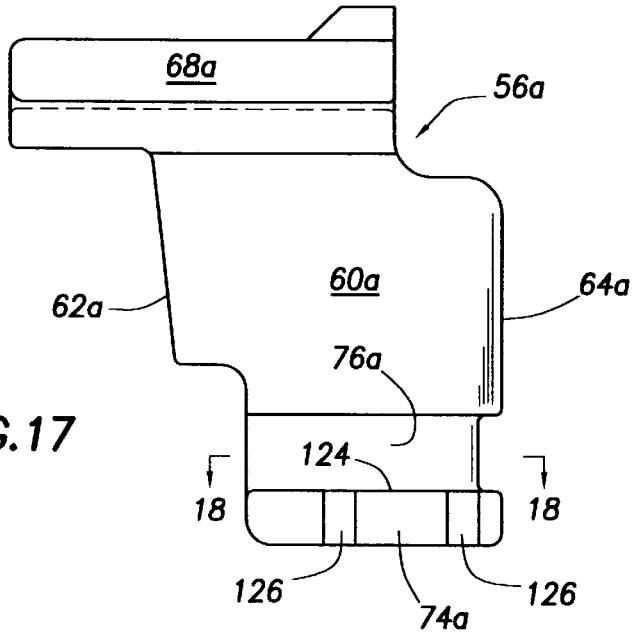
FIG. 17 is a side elevational view of a modified base member used in the FIG. 16 assembly.
Figure 18:
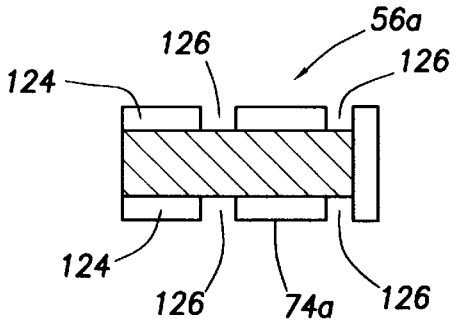
FIG. 18 is a cross-sectional view through the modified base member taken along line 18—18 of FIG. 17.

Bucket 10*a* is provided with a modified adapter 24*a* in which the previously described opposite side cutout areas 48 (see FIG. 6) are replaced on the modified bottom adapter leg 30*a* shown in FIG. 16 with a single bottom side cutout area 48*a* which is separated from the rear bottom leg cavity 42*a* by a dividing wall 50*a* having a circular opening 52*a* extending therethrough between the bottom side cutout area 48*a* and the rear leg cavity 42*a*. A modified base member 56*a*, as illustrated in FIGS. 17 and 18, is provided in which the upwardly facing ledge surfaces 124 of the bottom end portion 74*a* of the base member 56*a* have spaced apart pluralities of notches 126 formed therein and extending downwardly therethrough.

Figure 19:
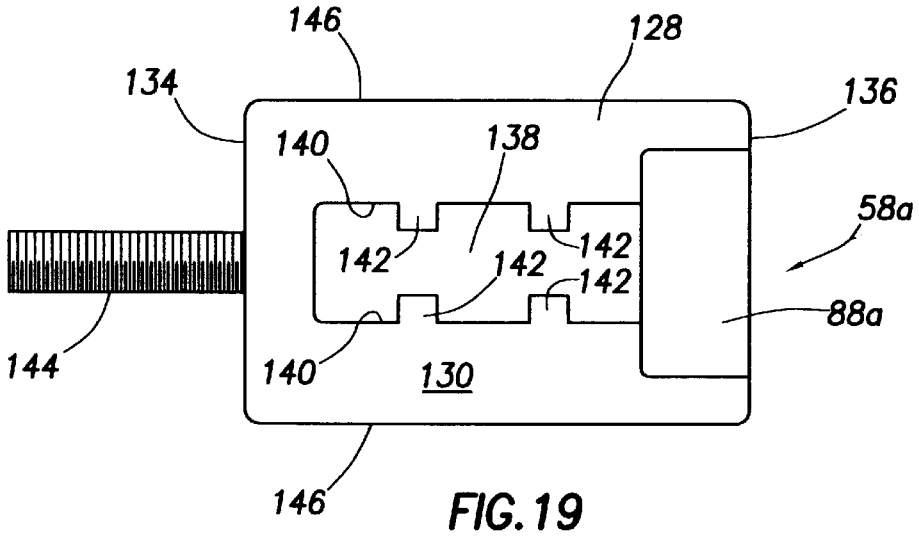
FIG. 19 is a top plan view of a modified base clamp member used in the FIG. 16 assembly.
Figure 20:
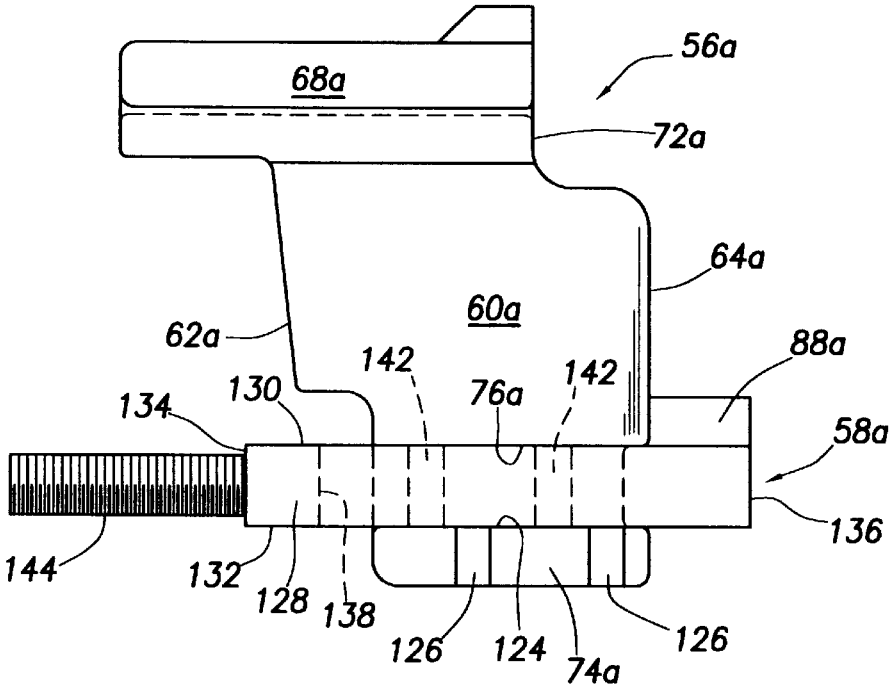
FIG. 20 is a side elevational view of the modified base and base clamp members in an assembled state.

Additionally, as illustrated in FIGS. 19 and 20, a modified base clamp member 58*a* is provided and includes a generally rectangular body 128 having top and bottom sides 130 and 132, front and rear ends 134 and 136, an upstanding rear end boss 88*a*, and an elongated rectangular central opening 138. The opening 138 is sized to permit the lower end 74*a* of the base member 56*a* to pass downwardly therethrough, and has opposite side edges 140 from which opposing pairs of lugs 142 project toward one another. The lugs 142 are sized and spaced to pass upwardly through the notches 126 in the lower base member end 74*a* as the lower base member end 74*a* is being passed downwardly through the opening 138. An elongated threaded stud 144 longitudinally projects forwardly from the front base clamp member end 134.

Turning now to FIG. 20, the base clamp member 58*a* is removably and interlockingly installed on the lower end of the base member 56*a* by passing the lower end 74*a* of the base member 56*a* downwardly through the base clamp member opening 138 in a manner such that the base clamp member lugs 142 pass upwardly through the notches 126 in the lower end 74*a* of the base member 56*a* and the clamp member body 128 is aligned with the lower side depressions 76*a* of the base member 56*a*. The base clamp member 58*a* is then slid forwardly through the depressions 76*a* until the lugs 142 overlie non-notched portions of the base member ledges 124 to thereby prevent the installed base clamp member 58*a* from falling off the base member 56*a*. In this manner, the base clamp member 58*a* is releasably interlocked with the base member 56*a*.

With the base clamp member 58*a* and the lower end 74*a* of the base member 56*a* operatively disposed within the lower adapter leg cavity 42*a* (see FIG. 16), the base clamp member 58*a* is also releasably interlocked with the lower adapter leg 30*a* by means of the complementary receipt of outer side edge portions 146 of the base clamp member body 128 (see FIG. 19) in the opposing side slots 44*a* (see FIG. 16) in the lower adapter leg cavity 42*a*. The threaded stud 144 extends forwardly, nonthreadingly and movably through the dividing wall opening 52*a* (see FIG. 16) into the bottom side cutout area 48*a* of the bottom adapter leg 30*a*. A nut 148 is threaded onto the exposed front end of the stud 144 and, as illustrated in FIG. 16, a pair of annular washers 116*a*,118*a* and a coiled compression spring 120*a* are interposed between the nut 148 and the front surface of the dividing wall 50*a*.

The nut 148 is tightened onto the front end of the stud 144 to compress the spring 120*a*, thereby exerting a rearwardly directed resilient force on the bottom adapter leg 30*a* relative to the lip structure 12*a*. In combination with the similar resilient force exerted on the adapter 24*a* by the spring-loaded J-bolt structure (not shown) associated with the top leg (also not shown) of the adapter 24*a*, this maintains a resilient, rearwardly directed self-tightening force on the installed adapter 24*a*.

This modified version of the second or lower fastening structure, which releasably connects the bottom adapter leg 30*a* to the bottom side 18*a* of the lip structure 12*a* provides a front access advantage similar to the previously described second fastening structure used in conjunction with the adapter 24 shown in FIG. 1. As can be seen in FIG. 16, the nut 148 forms for this modified second fastening structure a disconnection portion accessible, loosenable and removable from a front bottom portion 122*a* (see FIG. 16) of the adapter 24*a* (or other type of wear member as the case may be), disposed forwardly of the connected rear end portion of the bottom leg 30*a*, to permit the bottom adapter leg 30*a* to be disconnected from the bottom side 18*a* of the lip structure 12*a* without having to reach rearwardly under the lip structure 12*a* to the rear end 124*a* of the bottom adapter leg 30*a*.

The foregoing detailed description is to be clearly understood as being given by way of illustration and example only, the spirit and scope of the present invention being limited solely by the appended claims.

What is claimed is:

1. Apparatus for removably connecting a wear member to an excavating lip structure having a front edge from which top and bottom sides rearwardly extend, said wear member having a generally C-shaped cross section with a front end portion from which top and bottom legs rearwardly extend along opposite sides of a cavity configured to forwardly receive a front edge portion of said excavating lip structure, said apparatus comprising:

a first fastening structure useable to removably connect a rear end portion of said top leg to the top side of said excavating lip structure rearwardly of said front edge thereof; and a second fastening structure useable to removably connect a rear end portion of said bottom leg to the bottom side of said excavating lip structure rearwardly of said front edge thereof, said second fastening structure having a disconnection portion accessible and loosenable from a front bottom portion of said wear member, disposed forwardly of said rear end portion of said bottom leg, to permit said bottom leg to be disconnected from said bottom side of said excavating lip structure without having to reach under said lip structure to said rear end portion of said bottom leg of said wear member.

2. The apparatus of claim 1 wherein said disconnection portion of said second fastening structure is forwardly movable during loosening thereof.

3. The apparatus of claim 2 wherein said disconnection portion of said second fastening structure is a threaded member.

4. The apparatus of claim 3 wherein said threaded member is a nut.

5. The apparatus of claim 3 wherein said threaded member is a bolt.

6. The apparatus of claim 1 wherein at least one of said first and second fastening structures is operative to resiliently bias said front end portion of said wear member rearwardly toward said front edge of said excavating lip structure.

7. The apparatus of claim 1 wherein said wear member is an excavating tooth adapter.

8. The apparatus of claim 1 wherein:

said apparatus further comprises a base member removably securable to said excavating lip structure with an upper end portion extending above said top side of said excavating lip structure, and defining a portion of said first fastening structure, and a lower end portion extending below said bottom side of said excavating lip structure and defining a portion of said second fastening structure.

9. The apparatus of claim 8 wherein:

said excavating lip structure has an opening disposed therein rearwardly of said front edge and extending between said top and bottom sides of said excavating lip structure, and said base member is removably insertable in said opening.

10. The apparatus of claim 8 wherein said second fastening structure further includes:

a base clamp member releasably interlockable with said lower end portion of said base member and said bottom leg of said wear member, and a securement structure for releasably securing said bottom leg of said wear member to said base clamp member.

11. The apparatus of claim 10 wherein said securement structure includes:

a threaded member extendable from said base clamp member forwardly through a portion of said bottom leg of said wear member.

12. The apparatus of claim 11 wherein:

said threaded member is fixedly secured to said base clamp member and has a front end portion, and said disconnection portion is a nut threadable onto said front end portion of said threaded member.

13. The apparatus of claim 12 further comprising a spring member positionable to be compressed between said nut and a facing portion of said bottom leg of said wear member.

14. The apparatus of claim 11 wherein:

said threaded member is a bolt defining said disconnection portion and having a rear end threadable into said base clamp member, and a front end with a head thereon.

15. The apparatus of claim 14 further comprising a spring member positionable to be compressed between said head and a facing portion of said bottom leg of said wear member.

16. The apparatus of claim 8 wherein:

said bottom leg of said wear member is releasably interlockable with said lower end portion of said base member.

17. The apparatus of claim 10 wherein:

said base clamp member has a generally U-shaped configuration with opposite leg portions releasably interlockable with opposite side portions of said lower end portion of said base member.

18. The apparatus of claim 10 wherein:

said base clamp member has an opening therein through which said lower end portion of said base member may be downwardly inserted, and said base clamp member opening and said lower end portion of said base member have cooperating lug and recess portions useable to releasably interlock said base clamp member and said lower end portion of said base member.

19. The apparatus of claim 1 wherein said first fastening structure includes:

a J-bolt member insertable rearwardly through said top leg of said wear member, and a nut securable to a rear end portion of said J-bolt and being accessible at the rear end of said top leg.

20. Excavating apparatus comprising:

an excavating lip structure having a front edge from which top and bottom sides rearwardly extend;

a wear member having a generally C-shaped cross section with a front end portion from which top and bottom legs rearwardly extend along a cavity, a front edge portion of said lip structure being removably received within said cavity, with said top and bottom legs respectively extending rearwardly along said top and bottom sides of said lip structure;

a first fastening structure removably connecting a rear end portion of said top leg to said top side of said lip structure rearwardly of said front edge thereof; and a second fastening structure removably connecting a rear end portion of said bottom leg to said bottom side of said excavating lip structure rearwardly of said front edge thereof, said second fastening structure having a disconnection portion accessible and loosenable from a front bottom portion of said wear member, disposed forwardly of said rear end portion of said bottom leg, to permit said bottom leg to be disconnected from said bottom side of said lip structure without having to reach under said lip structure to said rear end portion of said bottom leg of said wear member.

21. The excavating apparatus of claim 20 wherein said disconnection portion of said second fastening structure is forwardly movable during loosening thereof.

22. The excavating apparatus of claim 21 wherein said disconnection portion of said second fastening structure is a threaded member.

23. The excavating apparatus of claim 22 wherein said threaded member is a nut.

24. The excavating apparatus of claim 22 wherein said threaded member is a bolt.

25. The excavating apparatus of claim 20 wherein at least one of said first and second fastening structures resiliently biases said front end portion of said wear member rearwardly toward said front edge of said excavating lip structure.

26. The excavating apparatus of claim 20 wherein said wear member is an excavating tooth adapter.

27. The excavating apparatus of claim 20 further comprising:

a first projection extending upwardly from said top side of said excavating lip structure and defining a portion of said first fastening structure, and a second projection extending downwardly from said bottom side of said excavating lip structure and defining a portion of said second fastening structure.

28. The excavating apparatus of claim 27 wherein:

said excavating lip structure has an opening disposed therein rearwardly of said front edge and extending between said top and bottom sides of said excavating lip structure, and said excavating apparatus further comprises a base member removably received in said opening and having upper and lower end portions that respectively define said first and second projections.

29. The excavating apparatus of claim 28 wherein said second fastening structure further includes:

a base clamp member releasably interlocked with said lower end portion of said base member and said bottom leg of said wear member, and a securement structure releasably securing said bottom leg of said wear member to said base clamp member.

30. The excavating apparatus of claim 29 wherein said securement structure includes:

a threaded member extending from said base clamp member forwardly through a portion of said bottom leg of said wear member.

31. The excavating apparatus of claim 30 wherein:

said threaded member is fixedly secured to said base clamp member and has a front end portion, and said disconnection portion is a nut threaded onto said front end portion of said threaded member.

32. The excavating apparatus of claim 31 further comprising a spring member compressed between said nut and a facing portion of said bottom leg of said wear member.

33. The excavating apparatus of claim 27 wherein:

said bottom leg of said wear member is releasably interlocked with said lower end portion of said base member.

34. The excavating apparatus of claim 29 wherein:

said base clamp member has a generally U-shaped configuration with opposite leg portions releasably interlocked with opposite side portions of said lower end portions of said base member.

35. The excavating apparatus of claim 29 wherein:

said base clamp member has an opening therein through which said lower end portion of said base member releasably and downwardly extends, and said base clamp member opening and said lower end portions have cooperating lug and recess portions operating to releasably interlock said base clamp member and said lower end portion of said base member, and being movable relative to one another in a first direction to permit removal of said base clamp member from said base member in a second direction transverse to said first direction.

36. The excavating apparatus of claim 30 wherein:

said threaded member is a bolt defining said disconnection portion and having a rear end threaded into said base clamp member, and a front end with a head thereon.

37. The excavating apparatus of claim 36 further comprising a spring member compressed between said head and a facing portion of said bottom leg of said wear member.

38. The excavating apparatus of claim 20 wherein said first fastening structure includes:

a J-bolt member extending rearwardly through said top leg of said wear member, a nut secured to a rear end portion of said J-bolt and being accessible at the rear end of said top leg, and a spring member interposed between said nut and a facing portion of said top leg of said wear member and resiliently biasing said front end portion of said wear member toward said front edge of said lip structure.

39. Excavating apparatus comprising a wear member having a generally C-shaped cross section with a front end portion from which top and bottom legs rearwardly extend along opposite sides of a cavity configured to forwardly receive a front edge portion of an excavating lip structure, said top and bottom legs having facing inner side surfaces, said inner side surface of said bottom leg having a recess formed therein, said bottom leg having at least one cutout area formed in an external side surface portion thereof disposed forwardly of said recess and separated therefrom by a dividing wall with an opening formed therein through which a threaded disconnection member may be extended, along a forwardly and rearwardly extending axis, between said cutout area and said recess.

40. The excavating apparatus of claim 39 wherein said wear member is an excavating tooth adapter.

41. The excavating apparatus of claim 39 wherein said at least one cutout area includes a pair of cutout areas formed on opposite exterior side surface portions of said bottom leg.

42. The excavating apparatus of claim 39 wherein said at least one cutout area is disposed on a bottom exterior side surface portion of said bottom leg.

43. The excavating apparatus of claim 39 further comprising a base member having a portion removably and interlockingly insertable into said recess.

44. The excavating apparatus of claim 43 wherein said base member is removably insertable through an opening in the excavating lip structure.

45. The excavating apparatus of claim 43 further comprising:

a base clamp structure removably insertable into said recess into interlocking engagement with said base member and said bottom wear member leg.

46. The excavating apparatus of claim 45 further comprising a threaded structure extendable through said dividing wall opening and useable to removably hold said base clamp member in interlocked engagement with said bottom wear member leg and said base member.

47. The excavating apparatus of claim 46 further comprising a resilient structure, connectable to said threaded structure within said at least one cutout area, for resiliently biasing said base clamp structure toward said dividing wall.

* * * * *